US008418273B1

(12) United States Patent
Dorsey

(10) Patent No.: US 8,418,273 B1
(45) Date of Patent: Apr. 16, 2013

(54) PROTECTIVE COVER FOR A TOILET SEAT AND TOILET BOWL

(76) Inventor: Natosha Dorsey, Los Angeles, CA (US)

( * ) Notice: Subject to any disclaimer, the term of this patent is extended or adjusted under 35 U.S.C. 154(b) by 391 days.

(21) Appl. No.: 12/589,571

(22) Filed: Oct. 26, 2009

(51) Int. Cl.
*A47K 13/14* (2006.01)
*A47K 13/24* (2006.01)

(52) U.S. Cl.
USPC ..... 4/245.5; 4/245.3

(58) Field of Classification Search ..... 4/245.1, 4/245.3–245.9
See application file for complete search history.

(56) References Cited

U.S. PATENT DOCUMENTS 5,557,809 A * 9/1996 Adams ..... 4/245.3
7,216,372 B2 * 5/2007 Escortell et al. ..... 4/245.6
8,196,228 B1 * 6/2012 Gyurjyan ..... 4/245.1

* cited by examiner

*Primary Examiner* — Huyen Le

(57) ABSTRACT

A protective covering for a toilet seat and toilet bowl is described, which prevents bodily contact with potentially germ-infected or wet surface areas of a toilet seat and a toilet bowl. The toilet seat and toilet bowl covering disclosed herein is particularly suitable for use by small children and is readily adaptable to accommodate toilet seats and toilet bowls of varying sizes.

13 Claims, 2 Drawing Sheets

PROTECTIVE COVER FOR A TOILET SEAT AND TOILET BOWL

BACKGROUND OF THE INVENTION

1. Field of the Invention

The present invention generally relates to toilet covers and, more particularly, to a sanitary device for covering a toilet seat and at least the front and side portions of a toilet bowl, effectively eliminating all bodily contact with the surface areas of the toilet seat and toilet bowl.

2. Background of the Invention

Public toilets are a haven for germs and bacteria. Among the germs sometimes found in public restrooms, are *streptococcus, staphylococcus*, and *E. coli* bacteria, hepatitis A virus, the common cold virus, and even various sexually transmitted organisms. Using public toilets is especially problematic for small children, who often grasp the sides of the toilet to lift themselves onto the seat or rest their hands on the toilet seat and bowl for balance. These facts makes most mothers cringe when they are away from home and hear their child say "Mommy, I need to potty." Also, unlike adults, children's legs often rest on the front or side surfaces of the toilet bowl when they are seated on the toilet, further increasing their contact with germs and bacteria.

Current toilet covers are limited in that they do not provide sufficient coverage to prevent bodily contact with potentially germ-infected surface areas of a toilet—particularly, the toilet seat and toilet bowl. Indeed, the typical toilet cover is designed to cover only the toilet seat and even that coverage is insufficient in that the cover is usually made of a thin paper material that does not fit the toilet seat securely.

Paper covers, which are cut in the shape of a standard toilet seat, tend to slide across or even off the toilet seat when someone attempts to sit on the toilet. They also tear easily and do not provide an effective barrier against wetness or other matter that may have splashed or fallen onto the toilet seat and toilet bowl.

Even existing toilet seat covers that protect against wetness, fail to protect against wetness and germs that may be found on the outer surface of the toilet bowl.

There exists, therefore, a need for a disposable toilet cover that fits both a toilet seat and toilet bowl securely; that effectively protects against bodily contact with potentially germ-infected surfaces of the toilet seat and toilet bowl; and that is specifically suitable for use by small children.

BRIEF SUMMARY OF THE INVENTION

The invention embodied and broadly described herein is a protective covering that fits both a toilet seat and toilet bowl securely, and that protects against bodily contact with potentially germ-infected surface areas of the toilet seat and toilet bowl.

According to one aspect of the invention, a continuous covering, sized to substantially cover both the toilet seat and the front and side surface areas of the toilet bowl, is secured about the rear of the toilet seat and extends about the base of the toilet bowl—along the front, left, and right sides of the bowl. In one embodiment, the covering is secured to the toilet seat and the toilet bowl using a securing element, such as elastic, affixed about the outer periphery of the covering. However, it is contemplated that a variety of different securing elements may be used. The toilet seat and toilet bowl covering also includes an opening that aligns atop the opening in a toilet seat, when the covering is secured to the toilet seat and the toilet bowl. In an exemplary embodiment, the covering is made of a durable material that provides a protective barrier against wetness and is adaptable to be secured about toilet seats and toilet bowls of varying sizes.

To enable a further understanding of the objectives of this invention, a brief description of the drawings is provided below, followed by a detailed description of various embodiments. It is to be understood that both the foregoing and the following descriptions are exemplary and explanatory only and are not intended to limit the claimed invention in any manner whatsoever.

BRIEF DESCRIPTION OF THE DRAWINGS

The accompanying drawings, which are incorporated in and constitute a part of this specification, exemplify certain aspects of the present invention and, together with the description, serve to explain some of the principles associated with the invention.

DETAILED DESCRIPTION OF THE INVENTION

Reference will now be made in detail to exemplary embodiments of the invention, examples of which are illustrated in the accompanying drawings. Where possible, the same reference numbers will be used throughout the drawings to refer to the same or like parts.

Figure 1:
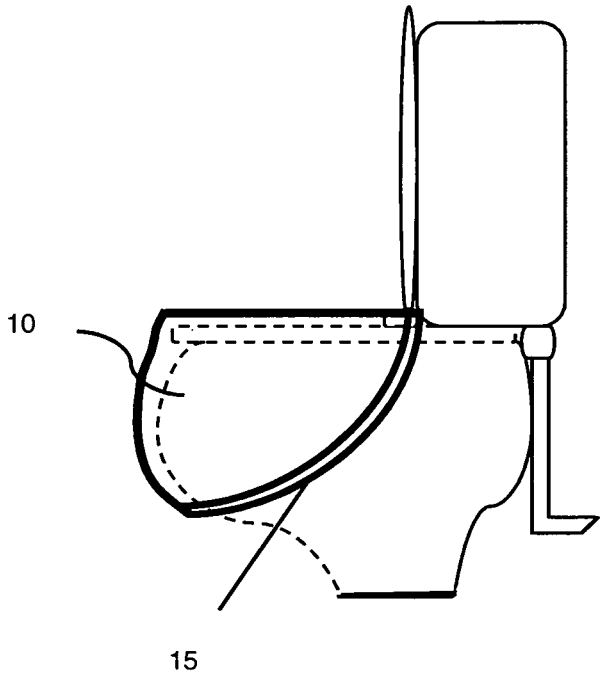
FIG. 1 is a perspective view of a first embodiment of the toilet seat and toilet bowl cover secured to a toilet seat and toilet bowl.
Figure 2:
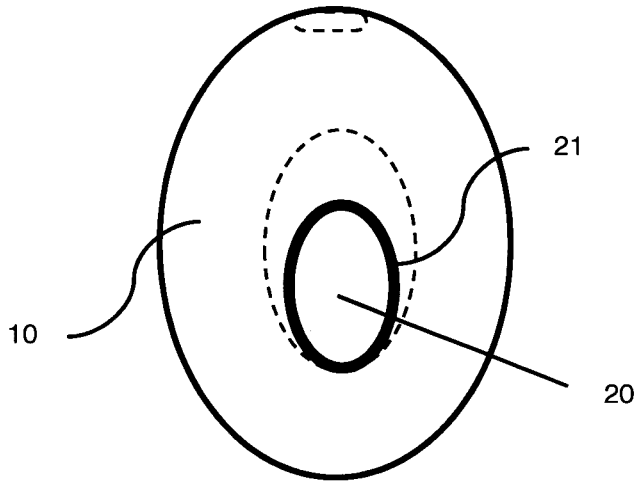
FIG. 2 is a top view of the first embodiment of the toilet seat and toilet bowl cover.

The disposable protective toilet seat and toilet bowl cover shown in FIG. 1 comprises a continuous covering 10, sized to substantially cover both the toilet seat and at least the front and side portions of the toilet bowl; and at least one securing element 15 affixed along the periphery of the covering 10, securing the covering 10 snugly and securely about the rear of the toilet seat and about the left, right and front base of the toilet bowl. The covering 10, as depicted in FIG. 2, further comprises at least one opening 20 that aligns atop the opening in the toilet seat when the covering 10 is secured to the toilet seat and toilet bowl.

Figure 3:
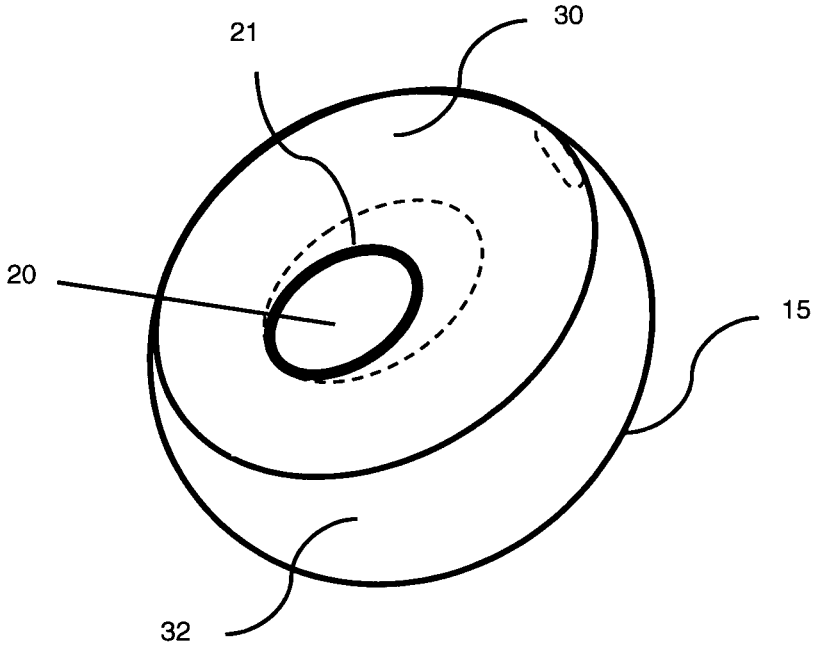
FIG. 3 is a perspective view of a second embodiment of the toilet seat and toilet bowl cover.

FIG. 3 illustrates an alternate embodiment, wherein the disposable protective toilet seat and toilet bowl cover comprises at least one toilet seat piece 30 sized to substantially cover a toilet seat and at least one toilet bowl piece 32, sized to substantially cover at least the front and side portions of the toilet bowl. Referring to FIG. 3, the outer periphery of the toilet seat piece 30 is affixed to the upper edge of the toilet bowl piece 32, forming a single covering 10 sized to substantially cover both the toilet seat and at least the front and side portions of the toilet bowl. At least one securing element 15 is affixed along the lower edge of the toilet bowl piece 32, securing the covering 10 to snugly about the rear of the toilet seat and about the left, right and front base of the toilet bowl. The toilet seat piece 30 includes at least one opening 20 that aligns atop the opening in the toilet seat when the covering 10 is secured to the toilet seat and toilet bowl, wherein the opening 20 is smaller than the opening in the toilet seat.

The covering 10 depicted in FIGS. 1 and 3, may be manufactured using materials having a laminate construction comprising at least two layers—an absorbent top layer that and a liquid impervious underside. The top layer may be paper or other fibrous material. The bottom layer may be a thin plastic or other liquid impervious material that prevents bodily contact with any moisture or wetness on the toilet seat and toilet bowl. In other embodiments, the covering 10 may have a single layer construction, comprising, for example, a single layer of plastic, paper, fabric or other material. Additionally, the top surface of the covering 10, whether multi- or single-layered, may be decoratively colored, and logos, slogans, or other artistic designs may be printed thereon.

As illustrated in FIGS. 1 and 3, the toilet seat and toilet bowl covering 10 covers both the toilet seat and the front and side surface areas of the toilet bowl. In one embodiment (FIG. 1), a securing element 15, affixed along the periphery of the covering 10, secures the covering 10 about the rear of the toilet seat and about the left, right and front base of the toilet bowl. In another embodiment (FIG. 3), a securing element 15, affixed along the bottom edge of the toilet bowl piece 32, secures the covering 10 about the rear of the toilet seat and about the left, right and front base of the toilet bowl. The securing element 15 embodied in FIG. 1 may comprise a continuous piece of elastic attached along the outer periphery of the covering 10. The elasticized periphery may then be secured about the rear of the toilet seat and about the sides and front base of the toilet bowl. Positioning the elasticized periphery below the curvature of the toilet bowl better secures the covering 10. It is contemplated that a variety of different securing elements 15 may be used to secure the covering 10 to the toilet seat and toilet bowl, including, but not limited to, any rubber-like material, a Lycra-type band, temporary adhesives, Velcro or string. Each of these may be affixed about or near the periphery of the covering 10. Although FIG. 1 shows a continuous covering 10, one skilled in the art will readily understand how to adapt the securing element 15 to a covering 10 that is formed by joining together a toilet seat piece 30 and at least one toilet bowl piece 32, such as the covering 10 depicted in FIG. 3.

When the covering 10 is properly secured to the toilet seat and toilet bowl, the opening 20 in the covering 10 aligns atop the opening in the toilet seat. As illustrated in FIG. 2, the opening 20 may comprise a pre-cut circular or ovular hole. Additionally, as shown in FIG. 2, the opening 20 may be reinforced by a ring of material to strengthen the opening 20 so that it maintains a circular or oval-like shape when the covering 10 is secured about the toilet seat and toilet bowl. The reinforcement ring 21 may be formed by materials including, but not limited to, various plastics, cardboard, elastic or any other strengthening material. In embodiments in which the covering 10 is made of paper, or like material, the opening 20 may comprise a circular or ovular perforation that may be easily torn away from the covering 10. The opening 20 depicted in FIGS. 2 and 3 may be further adapted for use by males, particularly male toddlers, by enlarging or making the opening 20 more elongated toward the front of the toilet seat.

It is contemplated that the toilet seat and toilet bowl cover of this invention may be manufactured in a variety of different dimensions to accommodate toilet seats and toilet bowls of varying sizes.

The present invention has been described in relation to particular examples, which are intended in all aspects to be illustrative rather than restrictive. It will be apparent to those skilled in the art that various modifications and variations can be made to adapt a particular situation or material to the teachings of the present invention without departing from the essential scope or spirit thereof.

Moreover, other implementations of the invention will be apparent to those skilled in the art from consideration of the specification and practice of the invention disclosed herein. It is intended that the specification and the examples be considered as exemplary only. To this end, it is to be understood that inventive aspects lie in less than all features of a single foregoing disclosed implementation. Thus, the true scope and spirit of the invention is indicated by the following claims.

What is claimed is:

1. A protective cover for a toilet seat and toilet bowl comprising:

a covering sized to substantially cover the top surface of a toilet seat and at least the left, right and front surface areas of a toilet bowl;

at least one securing element, affixed along the outer periphery of the covering, for securing the covering about the toilet seat and about, at least, the left, right and front surface areas of the toilet bowl;

the covering having at least one opening that aligns atop the opening in the toilet seat when the covering is secured about the toilet seat and the toilet bowl; and a reinforcement ring affixed along the edge of the opening, wherein the reinforcement ring maintains the shape of the opening when the covering is secured about the toilet seat and at least the left, right and front surface areas of the toilet bowl.

2. The protective toilet seat and toilet bowl cover of claim 1, wherein the covering is made of material having a laminate construction, comprising at least an absorbent top layer and at least a liquid impervious bottom layer.

3. The protective toilet seat and toilet bowl cover of claim 1, wherein decorative indicia, such as logos, slogans, or other artistic designs, are printed on the covering.

4. A protective cover for a toilet seat and toilet bowl comprising:

at least one toilet seat covering sized to substantially cover the surface of a toilet seat;

at least one toilet bowl covering, sized to substantially cover at least the left, right and front surface areas of a toilet bowl, wherein the upper edge of the toilet bowl covering is joined about the outer periphery of the toilet seat covering, forming a continuous covering;

at least one securing element affixed along the lower edge of the toilet bowl covering, for securing the covering about the toilet seat and about, at least, the left, right and front surface areas of the toilet bowl;

the toilet seat covering having at least one opening that aligns atop the opening in the toilet seat when the covering is secured about the toilet seat and the toilet bowl; and a reinforcement ring affixed along the edge of the opening, wherein the reinforcement ring maintains the shape of the opening when the covering is secured about the toilet seat and at least the left, right and front surface areas of the toilet bowl.

5. The protective toilet seat and toilet bowl cover of claim 4, wherein the covering is made of material having a laminate construction, comprising at least an absorbent top layer and at least a liquid impervious bottom layer.

6. The protective toilet seat and toilet bowl cover of claim 4, wherein decorative indicia, such as logos, slogans, or other artistic designs, are printed on the covering.

7. A protective cover for a toilet seat and toilet bowl comprising:

a covering sized to substantially cover the surface of a toilet seat and at least the left, right and front surface areas of a toilet bowl;

a means for securing the covering about the toilet seat and about at least the left, right and front surface areas of the toilet bowl; and the covering having at least one opening that aligns atop the opening in the toilet seat when the covering is secured about the toilet seat and the toilet bowl; and a reinforcement ring affixed along the edge of the opening, wherein the reinforcement ring maintains the shape of the opening when the covering is secured about the toilet seat and at least the left, right and front surface areas of the toilet bowl.

8. The protective toilet seat and toilet bowl cover of claim 7, wherein the covering is made of material having a laminate construction, comprising at least an absorbent top layer and at least a liquid impervious bottom layer.

9. The protective toilet seat and toilet bowl cover of claim 7, wherein decorative indicia, such as logos, slogans, or other artistic designs, are printed on the covering.

10. A protective cover for a toilet seat and toilet bowl comprising:

at least one toilet seat covering sized to substantially cover the surface of a toilet seat;

at least one toilet bowl covering, sized to substantially cover at least the left, right and front surface areas of a toilet bowl, wherein the upper edge of the toilet bowl covering is joined about the outer periphery of the toilet seat covering, forming a continuous covering;

a means for securing the toilet bowl covering about at least the left, right and front surface areas of the toilet bowl;

the toilet seat covering having at least one opening that aligns atop the opening in the toilet seat when the covering is secured about the toilet seat; and a reinforcement ring affixed along the edge of the opening, wherein the reinforcement ring maintains the shape of the opening when the covering is secured about the toilet seat and at least the left, right and front surface areas of the toilet bowl.

11. The protective toilet seat and toilet bowl cover of claim 10, wherein the covering is made of material having a laminate construction, comprising at least an absorbent top layer and at least a liquid impervious bottom layer.

12. The protective toilet seat and toilet bowl cover of claim 10, wherein decorative indicia, such as logos, slogans, or other artistic designs, are printed on the covering.

13. A protective cover for a toilet seat and toilet bowl comprising:

a covering means for substantially covering the surface of a toilet seat and at least the front, left and right surface areas of a toilet bowl;

a securing means for securing the covering means about the toilet seat and about at least the left, right and front base of the toilet bowl;

an opening means for forming at least one opening that aligns atop the opening in the toilet seat when the covering means is secured about the toilet seat and about the toilet bowl;

and a reinforcing means for strengthening the opening means so that the opening means maintains a circular or ovular-like shape when the covering means is secured about the toilet seat and the toilet bowl.

* * * * *